US006199774B1

(12) United States Patent
Ricco

(10) Patent No.: US 6,199,774 B1
(45) Date of Patent: Mar. 13, 2001

(54) PERFECTED ELECTROMAGNETIC METERING VALVE FOR A FUEL INJECTOR

(75) Inventor: Mario Ricco, Bari (IT)

(73) Assignee: Elasis Sistema Ricerca Fiat Nel Mezzogiorno Societa Consortile per Azioni, Pomigliano D'Arco (IT)

( * ) Notice: Subject to any disclaimer, the term of this patent is extended or adjusted under 35 U.S.C. 154(b) by 13 days.

(21) Appl. No.: 08/987,980

(22) Filed: Dec. 10, 1997

(30) Foreign Application Priority Data

Dec. 23, 1996 (IT) ..... TO960263 U

(51) Int. Cl.[7] ..... F02M 47/02

(52) U.S. Cl. ..... 239/533.8; 239/585.1; 251/129.16; 251/129.19

(58) Field of Search ..... 239/88, 91, 95, 239/533.2, 533.3, 533.8, 585.1, 585.2, 585.3, 585.4, 585.5; 251/129.16, 129.19

(56) References Cited

U.S. PATENT DOCUMENTS 4,142,683 3/1979 Casey et al. ..... 239/585
4,749,892 6/1988 Mesenich ..... 310/19
5,114,077 * 5/1992 Cerny ..... 239/585.3
5,381,999 * 1/1995 Ricco ..... 239/585.3
5,820,101 * 10/1998 Ricco ..... 239/585.1

FOREIGN PATENT DOCUMENTS 0404336 12/1990 (EP) .
0753658 1/1997 (EP) .

OTHER PUBLICATIONS

Patent Abstract of Japan vol. 010, No. 342 (M–536), 19 Nov. 1986 & JP 61 142358 A (Hitachi LTD), 30 Jun. 1986.

* cited by examiner

*Primary Examiner*—Andres Kashnikow
*Assistant Examiner*—Dinh Q Nguyen
(74) *Attorney, Agent, or Firm*—Ladas & Parry

(57) ABSTRACT

The metering valve has a shutter for a discharge conduit, and an electromagnet for controlling an armature disconnected from the respective stem and sliding along the stem by means of a sleeve. The stem is guided by a fixed sleeve and is pushed by a first spring to hold the shutter in the closed position, and a second spring keeps a shoulder of the armature resting axially against a C-shaped ring fitted to the stem. To reduce the overtravel of the armature with respect to the travel of the stem to move the shutter into the closed position, and to damp oscillation of the armature, provision is made, between the two sleeves, for a bush of calibrated thickness, which slides along the stem and is such as to form a small axial clearance with the sleeves.

9 Claims, 2 Drawing Sheets

PERFECTED ELECTROMAGNETIC METERING VALVE FOR A FUEL INJECTOR

BACKGROUND OF THE INVENTION

The present invention relates to a perfected electromagnetic metering valve for a fuel injector, in particular for internal combustion engines.

The metering valves of fuel injectors normally comprise a control chamber with a discharge conduit, which is normally closed by a shutter by means of a main spring, and which is opened by energizing an electromagnet to so move the armature as to overcome the force exerted by the spring. In known valves, the armature is normally rigidly connected to a stem sliding inside a fixed guide.

When closing the discharge conduit, the kinetic energy of the armature and the stem is dissipate in the impact of the shutter against the valve; and, when opening the discharge conduit, the kinetic energy of the return stroke of the armature and the stem is dissipated in the impact of the stem against a stop.

Such impact generates considerable force proportional to the mass and speed of the armature and stem and inversely proportional to the duration of impact, which is very short; and, on account of the hardness of the stem, ball and body of the valve, results in considerable rebound, both when opening and closing the valve, so that the movement of the armature fails to provide for steady operation of the injector.

One proposal to reduce rebound of the mass arrested in both the opening and closing stroke is to disconnect the armature from the stem, and provide a second spring weaker than the main spring and for pushing the armature against an element of the stem. In yet another known valve, the stem is provided with a flange housed inside a chamber in which fuel is circulated, and in which the movement of the flange creates a certain amount of turbulence to further reduce rebound.

Such known valves, however, present the drawback of not allowing a small interval between two consecutive movements of the armature, as requested, for example, by high-speed injection engines. In particular, such valves are unsuitable for engines requiring a preinjection of fuel shortly before the main injection. In which case, in fact, the overtravel of the armature with respect to the travel of the stem prevents the armature from returning to the idle position prior to the main injection.

SUMMARY OF THE INVENTION

It is an object of the present invention to provide a straightforward, reliable metering valve of the above type, designed to overcome the aforementioned drawbacks typically associated with known valves, and which provides for ensuring rapid return/arrest of the armature in the idle/stop position.

According to the present invention, there is provided a metering valve comprising a shutter for a discharge conduit of a control chamber; an electromagnet for activating an armature to control said shutter via an intermediate element; and a first spring acting on said intermediate element to keep said shutter in a closed position; said armature being disconnected from said intermediate element, and being held in an idle position resting against the intermediate element by a second spring; characterized in that stop means are provided for arresting the movement of said armature produced by said first spring; said stop means being independent of said shutter, and being so arranged as to reduce the overtravel of said armature with respect to the travel of said intermediate element, permit rapid return of said armature to the idle position, and damp the rebound of said armature produced by said first spring and said second spring.

More specifically, in a metering valve wherein the armature is substantially in the form of a disk forming one piece with a sleeve, and the intermediate element is in the form of a stem coaxial with the disk and on which the sleeve slides, said stop means comprise at least a bush of calibrated thickness and sliding freely on said stem between the armature and a fixed stop.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
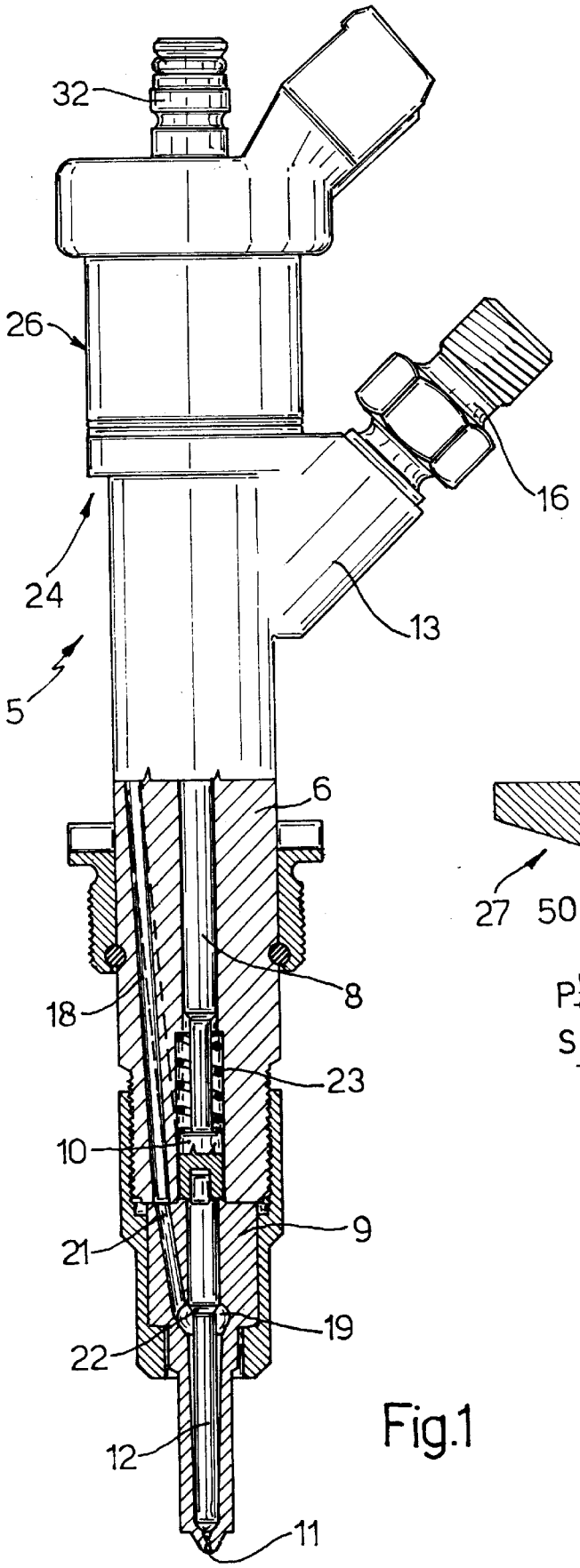
FIG. 1 shows a partially sectioned side view of a fuel injector featuring a metering valve in accordance with the present invention.

Number 5 in FIG. 1 indicates a fuel injector, e.g. for a diesel internal combustion engine, comprising a hollow body 6 connected to a nozzle 9 terminating with one or more injection orifices 11; and a control rod 8 slides inside body 6, and is connected by a plate 10 to a pin 12 for closing orifice 11.

Figure 2:
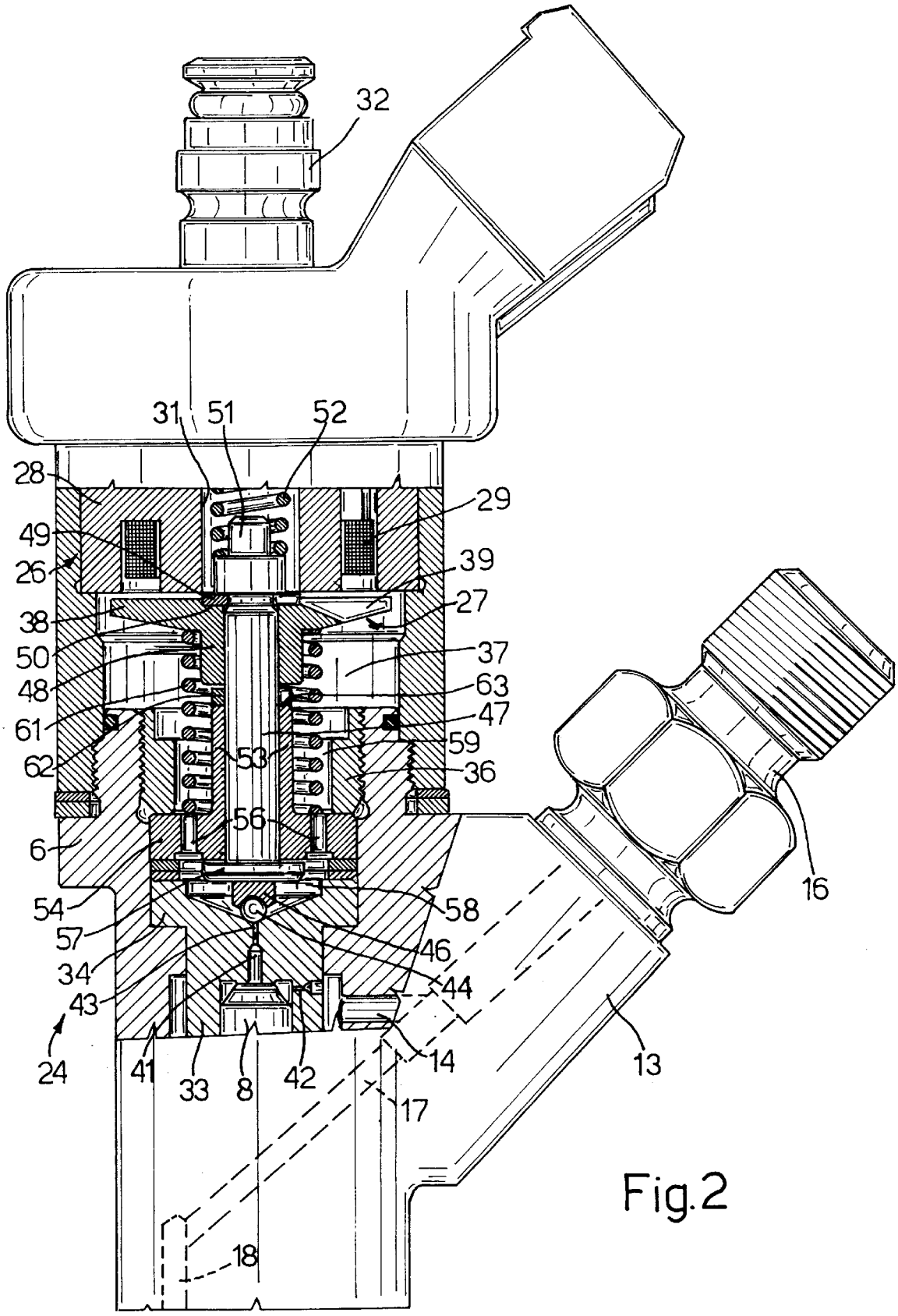
FIG. 2 shows a larger-scale half section of the metering valve of the FIG. 1 injector.

Body 6 comprises an appendix 13 in which is inserted an inlet fitting 16 connected to a normal fuel supply pump, and which in turn comprises a hole 14 (FIG. 2) communicating via conduits 17, 18 and 21 with an injection chamber 19 of nozzle 9; pin 12 comprises a shoulder 22 on which the pressurized fuel in chamber 19 acts; and a compression spring 23 assists in pushing pin 12 downwards.

Injector 5 also comprises a metering valve indicated as a whole by 24, and in turn comprising an electromagnet 26 for controlling an armature 27 (FIG. 2); electromagnet 26 comprises an annular magnetic core 28 housing a normal electric coil 29; and core 28 comprises a central hole 31 coaxial with a discharge fitting 32 integral with core 28 and connected to the fuel tank.

Metering valve 24 also comprises a body 33 having a flange 34 normally held resting against a shoulder of body 6 by an externally-threaded ring nut 36, which is screwed to a thread of a discharge chamber 37 formed in body 6; and armature 27 substantially comprises a disk 38, and has a number of sectors separated by slots 39 through which discharge chamber 37 communicates with central hole 31 of core 28.

Body 33 of valve 24 also comprises an axial control chamber 41 in turn comprising an inlet conduit 42 communicating with hole 14, and a discharge conduit 43 communicating with discharge chamber 37. Control chamber 41 is defined at the bottom by the top surface of rod 8; and, by virtue of the larger area of the top surface of rod 8 as compared with that of shoulder 22 (FIG. 1), the pressure of the fuel, with the aid of spring 23, normally keeps rod 8 in such a position as to close orifice 11 of nozzle 9.

Discharge conduit 43 of control chamber 41 is normally closed by a shutter in the form of a ball 44, which rests on a conical seat defined by the contact surface with conduit 43;

ball 44 is guided by a guide plate 46 on which acts an intermediate element comprising a cylindrical stem 47; and armature 27 forms one piece with a sleeve 48 sliding axially along stem 47, which comprises a groove housing a C-shaped ring 49 cooperating with a shoulder 50 of armature 27, so that armature 27 is disconnected from stem 47.

A given length of stem 47 projects inside hole 31 and terminates with a small-diameter portion 51 for supporting and anchoring a first compression spring 52 housed inside hole 31; stem 47 slides inside a fixed sleeve 53 forming one piece with a bottom flange 54 comprising axial holes 56; and, at the bottom, stem 47 comprises an integral flange 57, which is arrested against the bottom surface of flange 54.

Flange 54 is forced by ring nut 36 against flange 34 of body 33 of valve 24 via the interposition of calibrated washers for defining the desired travel of stem 47; and spring 52 is such as to move stem 47 and armature 27 rapidly downwards when electromagnet 26 is de-energized, and, by means of plate 46, to keep ball 44 in such a position as to close conduit 43.

Flange 57 of stem 47 is housed inside a swirl chamber 58 in which the fuel discharged from control chamber 41 is compressed and expanded by the movement of flange 57; and sleeve 53 forms with ring nut 36 a gap 59 enabling the fuel in chamber 58 to flow through holes 56 into discharge chamber 37.

A second spring 61 is provided between armature 27 and flange 54, and which acts on armature 27 so that shoulder 50 is normally held resting against ring 49 of stem 47. When electromagnet 26 is de-energized, spring 52 pushes stem 47 downwards, so that ball 44 is restored to the closed position and arrested, together with stem 47, against the conical surface of its seat over discharge conduit 43; and, as it moves down, stem 47 draws armature downwards by means of C-shaped ring 49.

As stem 47 is arrested, armature 27, on account of the speed at which it is traveling, tends to continue moving downwards, i.e. overtravel, by force of inertia, and is restored by second spring 61 and arrested with shoulder 50 against ring 49.

Figure 3:
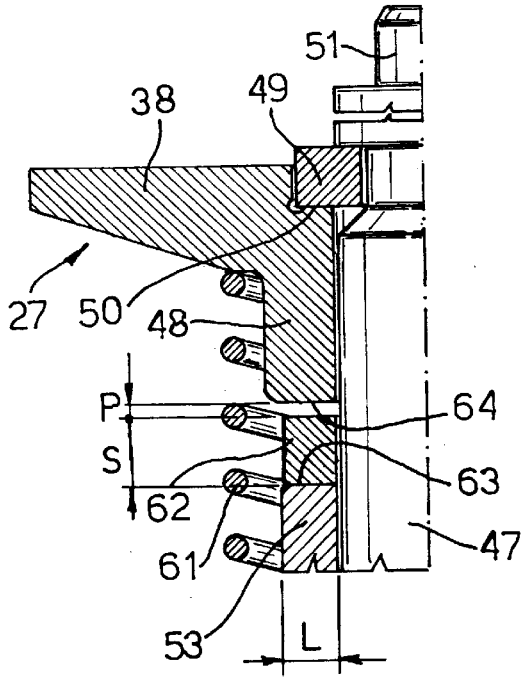
FIG. 3 shows a larger-scale detail of FIG. 2.

According to the invention, to restore armature 27 rapidly to the idle position, provision is made between fixed sleeve 53 and sleeve 48 of armature 27 for stop means comprising a bush 62 of calibrated thickness S (FIG. 3) Bush 62 is made of nonmagnetic material, is C-shaped for easy assembly to stem 47, may be made of any metal material, e.g. by sintering, is guided axially by stem 47 itself, and is located between an end surface 63 of sleeve 53 forming a fixed stop for armature 27, and an end surface 64 of sleeve 48 of armature 27.

Bush 62 has a rectangular section of width L substantially equal to the thickness of fixed sleeve 53; and thickness S of bush 62 is at least equal to width L, and is calibrated accurately to form, with surfaces 63 and 64 of sleeves 53 and 48, a very small predetermined total axial clearance P corresponding to the desired overtravel of armature 27 and preferably ranging from 0.05 to 0.1 mm.

The injector described operates as follows.

When coil 29 is energized (FIG. 2), core 28 attracts armature 27, which, by means of shoulder 50 and ring 49, positively draws stem 47 upwards in opposition to spring 52; flange 57 of stem 47 produces turbulence inside chamber 58 to cushion the arrest of flange 57 of stem 47 against fixed flange 54; and armature 27 is braked by the fuel inside discharge chamber 37 and arrested with shoulder 50 against C-shaped ring 49. The disconnection of armature 27 and stem 47 therefore provides for absorbing the kinetic energy of the two components separately.

The fuel pressure inside chamber 41 therefore moves ball 44 into the open position to discharge the fuel from chamber 41 back into the tank; and the fuel pressure inside chamber 19 (FIG. 1) overcomes the residual pressure on the upper surface of rod 8 to raise pin 12 and so inject the fuel in chamber 19 through orifice 11.

When coil 29 is de-energized, spring 52 pushes stem 47 down so as to draw armature 27 down by means of ring 49; the kinetic energy of stem 47 is also partly dissipated by the turbulence created by flange 57 in the fuel inside chamber 58, thus cushioning the impact of stem 47, plate 46 and ball 44; ball 44 closes discharge conduit 43; and the pressurized fuel restores the pressure inside control chamber 41, so that pin 12 (FIG. 1) closes orifice 11.

As stem 47 is arrested, armature 27 continues moving downwards by force of inertia in opposition to spring 61, so as to overtravel with respect to the travel of stem 47 to move ball 44 into the closed position, and is therefore arrested by bush 62, rebounds off the bush, and is oscillated by spring 61. The overtravel and subsequent oscillation, however, are limited to the small clearance P between bush 62 and surfaces 63 and 64 of sleeves 53 and 48.

Moreover, the kinetic energy during the overtravel of armature 27 is partly transmitted to bush 62, which in turn rebounds off surface 63 of sleeve 53 and oscillates at a speed inversely proportional to its mass, thus greatly reducing the kinetic energy of armature 27, rapidly damping rebound in both directions, and so greatly reducing the interval between the preinjection and main injection movements of armature 27.

As compared with known valves, the advantages of metering valve 24 according to the present invention will be clear from the foregoing description. In particular, bush 62 provides for rapidly arresting armature 27 against ring 49, thus reducing the interval between two successive operations of armature 27, and enabling a corresponding increase in engine speed.

Clearly, changes may be made to the metering valve as described and illustrated herein without, however, departing from the scope of the present invention. For example, the stop means may be so arranged as to arrest a different part of armature 27; and stop bush 62 may be replaced by two or more separate rings for defining predetermined total clearance P and, hence, the maximum predetermined travel of armature 27.

Moreover, second spring 61 may be replaced by a leaf spring or by one or more Belleville washers; and bush 62 may also be used effectively in a metering valve without a swirl chamber.

I claim:

1. An electromagnetic metering valve for a fuel injector, comprising a shutter (44) for a discharge conduit (43) of a control chamber (41); an electromagnet (26) for activating an armature (27) to control said shutter (44) via an intermediate element (47); and a first spring (52) acting on said intermediate element (47) to keep said shutter (44) in a closed position; said armature (27) being disconnected from said intermediate element (47), and being held in an idle position resting against the intermediate element (47) by a second spring (61); characterized in that stop means (62) are provided for arresting the movement of said armature (27) produced by said first spring (52) said stop means (62) being independent of said shutter (44), and being so arranged as to reduce the overtravel of said armature (27) with respect to the travel of said intermediate element (47), permit rapid return of said armature (27) to said idle position, and damp the rebound of said armature (27) produced by said first spring (52) and said second spring (61).

2. A valve as claimed in claim 1, wherein said armature (27) is guided by said intermediate element (47); characterized in that said stop means comprise at least one member (62) guided by said intermediate element (47) and movable freely between said armature (27) and a fixed stop (63).

3. A valve as claimed in claim 2, wherein said armature (27) comprises a disk (38) forming one piece with a sleeve (48), and said intermediate element is in the form of a stem (47) coaxial with said disk (38); said sleeve (48) sliding on said stem (47); characterized in that said member is in the form of a bush (62) of calibrated thickness (S) and sliding on said stem (47).

4. A valve as claimed in claim 3, characterized in that said bush (62) of calibrated thickness (S) is C-shaped for easy fitment to said stem (47).

5. A valve as claimed in claim 3, wherein said stem (47) in turn slides inside a fixed sleeve (53); characterized in that said fixed stop comprises an end surface (63) of said fixed sleeve (53).

6. A valve as claimed in claim 5, characterized in that said bush (62) of calibrated thickness (S) is located between said end surface (63) and an end surface (64) of the sleeve (48) of said armature (27), and is so sized as to form with said end surfaces (63, 64) an axial clearance of 0.05 to 0.1 mm.

7. A valve as claimed in claim 3, characterized in that said bush (62) of calibrated thickness (S) has a rectangular section of a width (L) substantially equal to the thickness of said fixed sleeve (53); said calibrated thickness (S) being at least equal to said width (L).

8. A valve as claimed in claim 3, characterized in that said second spring is a helical compression spring (61) located between said disk (38) and a flange (54) integral with said fixed sleeve (53).

9. A valve as claimed in claim 1, characterized in that said stem (47) comprises a flange (57) movable inside a swirl chamber (58) located between said control chamber (41) and a discharge chamber (37) in which to discharge fuel from said control chamber (41).

* * * * *